US005289875A

United States Patent [19]

Stokley et al.

[11] Patent Number: 5,289,875

[45] Date of Patent: * Mar. 1, 1994

[54] APPARATUS FOR OBTAINING SUBTERRANEAN FLUID SAMPLES

[75] Inventors: Charles O. Stokley; Lawrence Sanford, both of Houston, Tex.

[73] Assignee: Tam International, Houston, Tex.

[ * ] Notice: The portion of the term of this patent subsequent to Aug. 11, 2009 has been disclaimed.

[21] Appl. No.: 926,930

[22] Filed: Aug. 7, 1992

Related U.S. Application Data

[63] Continuation of Ser. No. 748,671, Aug. 22, 1992, Pat. No. 5,137,086.

[51] Int. Cl.[5] ..... E21B 49/08

[52] U.S. Cl. ..... 166/264; 166/66; 166/191; 166/242; 166/313; 166/321; 166/332

[58] Field of Search ..... 166/264, 250, 313, 66, 166/191, 332, 115, 321, 319, 169, 113, 242, 386

[56] References Cited

U.S. PATENT DOCUMENTS

| | | | |
|---|---|---|---|
| 3,073,392 | 1/1963 | Dinning et al. | 166/332 |
| 3,384,170 | 5/1968 | Van Poollen | 166/264 |
| 4,108,243 | 8/1978 | King et al. | 166/66 |
| 4,149,593 | 4/1979 | Gazda et al. | 166/113 |
| 4,222,438 | 9/1980 | Hollingsworth et al. | 166/250 |
| 4,278,131 | 7/1981 | Jani | 166/332 |
| 4,535,843 | 8/1985 | Jageler | 166/250 |
| 4,573,532 | 3/1986 | Blake | 166/264 |
| 4,678,035 | 7/1987 | Goldschild | 166/250 |
| 4,790,378 | 12/1988 | Montgomery et al. | 166/66 |
| 4,898,236 | 2/1990 | Sask | 166/264 X |
| 4,917,191 | 4/1990 | Hopmann et al. | 166/386 X |
| 4,964,460 | 10/1990 | Armell et al. | 166/113 |

FOREIGN PATENT DOCUMENTS

| | | | |
|---|---|---|---|
| 891900 | 12/1981 | U.S.S.R. | 166/264 |

*Primary Examiner*—Hoang C. Dang

*Attorney, Agent, or Firm*—Browning, Bushman, Anderson & Brookhart

[57] ABSTRACT

Improved methods and apparatus are provided for obtaining multiple fluid samples from subterranean formations of interest. The present invention is particularly well suited for testing nuclear migration in ground water utilizing test wells surrounding a nuclear test site. A plurality of flow ports are provided in the casing each at a depth of a formation of interest, and a sliding sleeve is positioned over each port. A wireline tool is lowered to the selective depth, and downhole electric motor energized to power a pump and pass pressurized fluid to move a first dog radially outward. The downhole tool may be axially moved until the first dog locks into a groove provided in the casing. Fluid entering the casing is sealed above and below the sliding sleeve. Fluid pressure may then be applied to move a second dog radially outward to engage the sliding sleeve, and a control valve regulated to apply fluid pressure to axially move the sleeve and open the port. Entering fluid may be tested by a downhole tester, and a signal transmitted to the surface. If the fluid is determined to be representative of the downhole fluid to be tested, fluid is then passed to a chamber within the downhole tool so that it may subsequently be retrieved to the surface. The release of hydraulic pressure allows the dogs to disengage from the casing and the sliding sleeve, and the tool may be moved to another depth. Using the procedures of the present invention, multiple fluid samples may be reliably obtained at selected depths with a single wireline run, thereby substantially reducing costs.

28 Claims, 2 Drawing Sheets

APPARATUS FOR OBTAINING SUBTERRANEAN FLUID SAMPLES

This is a continuation of application Ser. No. 07/748,671, filed Aug. 22, 1992, now U.S. Pat. No. 5,137,086.

FIELD OF THE INVENTION

The present invention relates to equipment and procedures for obtaining subterranean fluid samples from a wellbore. More particularly, this invention relates to improved techniques for inexpensively and reliably obtaining multiple fluid samples each from a corresponding zone in the wellbore without contaminating the downhole formations.

BACKGROUND OF THE INVENTION

Various techniques have been devised to test subterranean fluids. In the hydrocarbon recovery industry, coiled tubing units are commonly used to transmit sample fluids from a particular zone in the well to the surface for testing of the fluid. This procedure may be performed either in open (uncased) boreholes, or in cased boreholes which includes a sliding sleeve which selectively opens a port to allow communication between the formation and both the interior of the casing and the lower end of the coiled tubing. To prevent contamination between subterranean zones, inflatable packers, grout or cement may be used to seal the casing above and below the sliding sleeve. The coil tubing technique is, however, expensive and time-consuming. In order to reduce expense, some oil recovery operators use wireline test tools which can be quickly and inexpensively lowered into a wellbore to test fluid samples without retrieving the samples to the surface. This procedure is, however, frequently considered unreliable.

U.S. Pat. No. 4,222,438 discloses a fluid sampling procedure to determine downhole conditions in a fluid-producing subterranean reservoir. A downhole test tool is suspended from a wireline, and engages a shoulder at the lower end of a tubing string to position the test tool at a desired depth. U.S. Pat. No. 4,535,843 discloses a wireline tool for sampling borehole fluids and transmitting preliminary sample results to the surface. Based on these preliminary results, the operator may determine if samples should be collected in the tool and retrieved to the surface. The downhole tool includes a hydraulic pump and motor for inflating a double packer and either drawing sample fluid into a container chamber within the tool, or rejecting the sample fluid into the borehole. A control system to reduce the number of solenoid valves in a downhole sample tool is disclosed in U.S. Pat. No. 4,573,532.

While various downhole fluid sampling techniques have the common purpose of testing fluids, unique problems are presented when sampling for particular properties and when sampling under particular conditions. When testing for the presence and/or level of contamination of water in subterranean formations adjacent nuclear plants, nuclear test sites, or landfills, the high reliability required of the testing procedure may necessitate that the sampled fluid be brought to the surface, either for testing or for verification of any downhole testing. Also, the testing procedure must prevent any contamination of the subterranean formation. Relatively small diameter test wells have been drilled surrounding such sites for the purpose of determining whether any, and hopefully ensuring that no, contamination is migrating out of the test site with subterranean fluids, such as water. To conduct meaningful tests, each subterranean zone which might possibly be in fluid communication with the subterranean mass known to be contaminated must be checked. Since each test well may have multiple test zones which should be tested several times a typical year for a period of 20 years, and since there are numerous potentially contaminated sites located both within and outside the United States, subterranean tests must be reliably performed at a reasonable cost.

A significant difficulty with devising a subterranean migration test as outlined above is a requirement that any fluids withdrawn from the formation not be allowed to be returned to either a withdrawn zone or any other subterranean zone. Fluid may be contaminated, and its injection into another zone would mean that the testing procedure itself has caused increased contamination. Also, if any fluid is reinjected in a zone, it is likely that this reinjected fluid will be withdrawn and retested, so that over time the same fluid is repeatedly tested and a true indication of zone contamination at a particular well site is not obtained. Also, the very act of reinjecting any fluid in any zone may alter the normal flow of subterranean fluids, thereby invalidating the test.

One procedure which has been suggested for migration testing is to drill a test well to the depth of each zone to be tested, and then case the test well down to the test depth. While this procedure minimizes the chances of contamination between zones, it requires a separate well to test each zone at a particular well site, which is not cost feasible. Another alternative is to drill a single well at each test site with a sliding sleeve in the casing at the depth of each zone to be tested. To test the zone at a particular depth, a tool may be used to mechanically open the sliding sleeve at this depth. If the well is evacuated and a plug positioned in the bottom of the well, water in the zone will flow into the well when the sliding sleeve is opened. After the sliding sleeve is shifted closed, test fluid within the well may be withdrawn to the surface by injecting nitrogen gas through coiled tubing inserted into the well, thereby lifting the fluid to the surface in the annulus between the casing and the coiled tubing. Since any test fluid in any zone obtained at any time might contaminate subsequent tests, the entire well must be pumped dry above the bottom test plug, and care taken to ensure that the well was completely evacuated. This procedure is also costly and time-consuming, and requires the storage of a significant quantity of water until tests can verify that the fluid is not contaminated. The entire quantity of fluid withdrawn during each test must then be handled by proper treatment or disposal techniques.

The disadvantages of the prior art are overcome by the present invention. Improved methods and apparatus are hereinafter disclosed for inexpensively and reliably conducting subterranean fluid tests. While the techniques of the present invention may be used for testing various fluids for various purposes, the invention is particularly well suited for determining whether there is migration from a particular site with the subterranean fluids, such as water.

SUMMARY OF THE INVENTION

For each zone or depth to be tested, a suitable embodiment of the present invention employs a sliding sleeve, and a top sub with a locking groove within the test well casing. The sliding sleeve selectively opens or closes a port for fluid communication between the zone or formation of interest and the interior of the casing. Inflatable packers or other sealing members are used to seal the casing above and below the sliding sleeve during the test. A wireline tool includes an electric motor, a pump driven by the motor, a fluid analyzer/recorder/transmitter, a plurality of sample chambers, and an actuating tool. The actuating tool includes a first set of dogs for fixing the tool axially at the desired depth, and a second set of dogs for engaging and axially moving the sleeve to open or close the flow port. Each set of dogs is spring biased radially inward and is movable radially outward in response to fluid pressure generated by the downhole pump. The sleeve is driven axially by a piston which is also powered by the pump. The dogs are specially designed for locking engagement with their respective profiles, thereby ensuring that the first set of dogs does not lockingly engage the sleeve.

According to the method of the present invention, the test well casing includes a top sub and a sliding sleeve for each zone to be tested. To conduct a test at a specific zone, the wireline tool is lowered to a depth below the locking sleeve for the zone to be tested. Packers may be used to seal above and below the wireline tool. The electric motor is then powered to actuate the pump and generate fluid pressure sufficient to move both the first and second set of dogs radially outward. Once the dogs are extended, the wireline tool is raised within the wellbore until the first set of dogs engages its corresponding groove in the top sub, thereby properly positioning the wireline tool with respect to the sliding sleeve. At this time, the inflatable packers above and below the wireline tool may be set to isolate the interior of the casing within the vicinity of the zone to be tested. A pulse transmitted through the wireline may then actuate a valve to cause hydraulic pressure generated by the pump to act on the piston, thereby axially moving the sleeve to open the port in the casing and allow communication between the zone to be tested and the interior of the tool. Seals carried on the sliding sleeve are provided for maintaining a seal between the sliding sleeve and the casing, and if desired, the integrity of the sliding sleeve seal may be verified prior to axially moving the sleeve by actuating the pump to generate and maintain a desire vacuum within the tool.

After the port is opened, the fluid in the test zone will flow through the port into the interior of the wireline tool, and then to an analytical chamber, where a downhole test device may conduct initial tests to determine that the obtained sample appears to be representative of the test zone fluid. The fluid sample may then be pumped into a suitable one of various sample chambers within the wireline tool. If the sample is determined not to be representative of the test zone fluid, the sample will nevertheless be passed to one of the sample chambers, but another sample will be obtained and initially checked by the downhole instrument until a representative sample has been obtained and is collected within a suitable sample chamber. Once a representative sample has been obtained and is properly contained within a suitable chamber in the test tool, a signal transmitted through the wireline tool will actuate a control valve to act upon the piston and drive the sleeve back to its closed position. With the port closed, the pump may be activated to pressure up on the interior chamber within the actuating tool to both ensure that all fluid within the casing and between the set packers has been discharged to a chamber in the wireline tool, and to verify that the sleeve has obtained proper sealing integrity with the casing. Once sealing integrity has been verified, the fluid pressure applied to the first and second sets of dogs may be released so that the dogs move radially inward, and the packers and wireline tool then moved to another zone within the test well. Using the above procedure, each of various zones within the test well may be checked and reliable samples obtained at the surface in a single wireline run.

It is an object of the present invention to provide a reliable yet relatively inexpensive technique for obtaining subterranean fluid samples each from a corresponding zone within a well. The samples may be tested downhole and retrieved to the surface for additional testing and/or verification of the downhole test.

It is a further object of the present invention to provide a wireline fluid test tool which does not permit fluid drawn into the wellbore to be released back into any formation.

It is a feature of the present invention that a sliding sleeve in the wellbore is operated by a wireline tool and is driven in response to fluid pressure to both open and close the port.

It is another feature of the invention that a wireline fluid test tool is employed which enables the sealing integrity of the sliding sleeve to be easily verified both prior and subsequent to the collection of fluids from the test zone.

Still a further feature of this invention is that system reliability is enhanced by facilitating retrieval of a defective wireline tool, and by designing the sliding sleeve so that it may also be mechanically operated utilizing a downhole tool at the end of a tubing string extending to the surface.

A significant feature of the present invention is that the technique is well suited for testing migration of fluids within multiple zones and at multiple test wells.

An advantage of this invention is that the proper positioning of the wireline tool may be easily verified prior to opening the sliding sleeve.

A further advantage of the present invention is that the sliding sleeve may be activated with different downhole tools, and that the wireline tool may be used to activate various sliding sleeves in different test wells.

These and further objects, features, and advantages of the present invention will become apparent from the following detailed description, wherein reference is made to figures in the accompanying drawings.

DETAILED DESCRIPTION OF PREFERRED EMBODIMENTS

Figure 1:
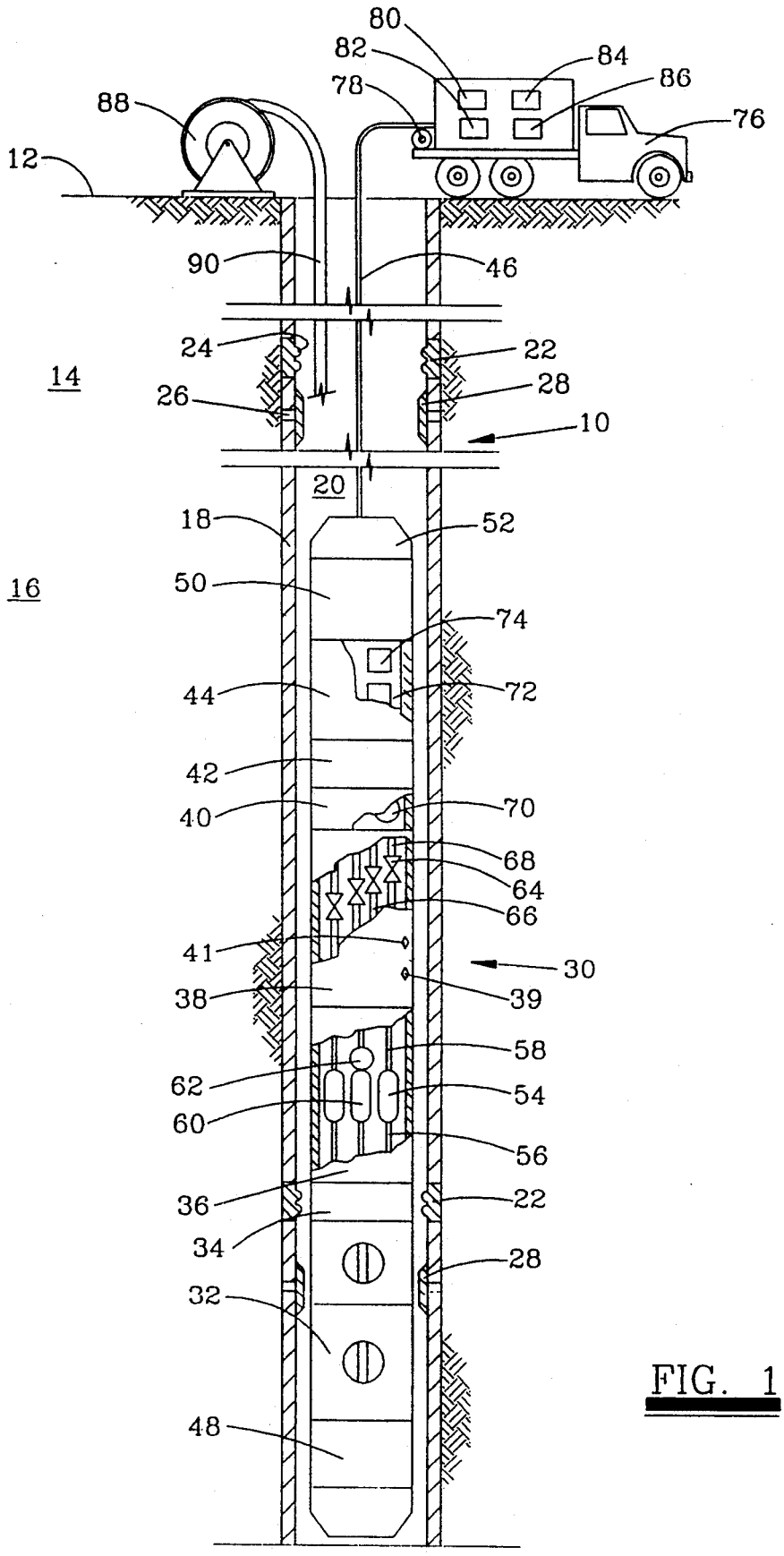
FIG. 1 is a simplified pictorial view of a portion of a test well according to the present invention including a sliding sleeve for each of various test zones and a wireline test tool positioned adjacent one of the zones.

FIG. 1 depicts a simplified test well and a simplified downhole tool for obtaining a fluid sample from each of multiple subterranean formations of interest. The present invention is particularly well suited for conducting nuclear migration tests in water for multiple underground formations, and accordingly this embodiment is described in detail below. In a typical application, the test well depicted in FIG. 1 may be one of multiple test wells surrounding a nuclear test site, and the primary purpose of the method and apparatus described below is to verify that nuclear material is not escaping from the test site through any one of multiple formations or zones possibly in communication with the underground contaminated mass. Although the description of this invention for conducting nuclear test sites will enable one to appreciate the features and advantages of the invention, it should be understood that the invention is not limited to conducting nuclear migration tests, and has a broad range of uses for conducting tests of various gas or liquid samples in underground formations.

FIG. 1 depicts a test well 10 extending from the surface 12 through multiple formations or zones, with only exemplary zones 14 and 16 being depicted. The well includes a conventional casing 18 extending through these zones, and defining a borehole 20 therein. Within each zone to be tested is an upper sub 22 which functionally forms part of the casing string, with the sub 22 including a locking slot 24 discussed in detail below. The casing within each zone to be tested also includes one or more ports 26 of the same axial elevation extending through the casing, and a sliding sleeve 28 for selectively covering and uncovering the ports. A test well extending through five test zones would thus preferably include within each of the zones an upper sub 22 and a sliding sleeve 28 covering at least one port through the casing, with the port being in fluid communication with the zone of interest. The test tool assembly described subsequently is shown in FIG. 1 adjacent zone 16, and top sub 22 and sliding sleeve 28 within zone 16 may thus be identical to the components generally shown in zone 14.

FIG. 1 depicts a simplified test tool assembly 30 within the borehole 20 surrounded by formation or zone 16. The test tool assembly 30 may typically include an actuating tool 32, a conventional safety sleeve 34 above the actuating tool, a reservoir housing 36 above the safety sleeve, a control valve housing 38 above the reservoir housing, a fluid pump 40 above the control valve housing, an electrically powered motor 42 above the pump, and an electronics housing 44 above the motor. The entire test tool assembly 30 may be suspended in the borehole 20 by any suitable means, such as by a tubing string, by coiled tubing, by a cable, or by an electrically conductive wireline 46. If the assembly 30 is suspended from means other than wireline 46, wireline 46 nevertheless preferably extends from the surface 12 down to the test assembly 30 in order to transmit control signals to the control valve housing 38. The motor 42 and the pump 40 are preferably provided as part of the downhole assembly 30, and the electric motor is powered by current passing through the wireline 46 for driving the pump and generating fluid pressure. FIG. 1 also depicts a conventional lower packer 48 beneath the actuator 32, and an upper packer 50 above the electronics housing 44. Each of these packers provides a conventional sealing function, as explained subsequently, and may or may not be a component of the test tool assembly 30. A wireline adapter 52 is preferably provided for securely connecting the wireline 46 to the test assembly 30.

The reservoir housing 36 provides a plurality of test chambers 54 therein, with only a few representative test chambers being simplistically depicted in FIG. 1. A flow line 56 allows test fluid to pass to each respective test chamber, and fluid pressure or vacuum in the test chamber is controlled by a line 58 extending upward to the control valve housing. One of the test chambers may be an analytical chamber 60, and a downhole test analyzer 62 is provided for analyzing the fluid within chamber 60 while the assembly 30 is downhole. Fluid pressure (or vacuum) in each of the test chambers 54 may be controlled by a respective solenoid valve 64 provided within the control valve housing 38, with a fluid line 66 extending from each solenoid valve to a respective line 58 and to a respective test chamber 54. A line 68 extends from a respective solenoid valve to chamber 70 provided within the housing of the pump 40. It should thus be understood that current passing through wireline 46 powers motor 42, which in turn drives pump 40 for creating a pressure or vacuum in chamber 70. Control signals may be passed through the wireline 46 for actuating one or more of the plurality of solenoid valves 64, so that these control signals may regulate the pressure or vacuum in each of the plurality of test chambers 54. Fluid lines extending from other of the solenoid valve 64 may pass to the actuator 32 for performing operations described subsequently.

The output from analyzer 62 may be passed via wiring (not shown) to a conventional downhole recorder 72 provided within the electronics housing 44, and a conventional transmitter 74 in housing 44 provided for transmitting a signal via wireline 46 from the analyzer 62 to the surface. It should be understood that conventional electronics may be provided within housing 44 for separating and transmitting control signals passed through the wireline 46 to each of the plurality of control valves. Also, those skilled in the art will appreciate that a solenoid valve for each of the control lines within the test tool assembly may be provided as shown in FIG. 1, although a more practical arrangement may include one or more manifold valves or a control mechanism of the type disclosed in U.S. Pat. No. 4,573,532.

A portable vehicle, such as truck 76, may be provided at the surface for performing the testing function. Such trucks are conventional in the oil recovery industry for conducting wireline operations, and include a powered winch 78 for extending or retrieving wireline 46 to raise or lower wireline tools in a borehole, a receiver 80 for receiving electrical signals sent up the wireline 46 from downhole sensors or analyzers, a transmitter 82 for forwarding control signals through the wireline 46 to operate the downhole tool and the downhole electronics package, a generator 84 for generating electrical power to be transmitted through the wireline 46, and a monitor 86 for operator viewing in real time of control signals, test results, and similar information.

As previously noted, the wireline 46 need not be the means which structurally suspends the assembly 30 within the borehole and raises or lowers the assembly 30 to its desired position. One alternative would be to use a coiled tubing unit 88 at the surface, with coiled tubing 90 extending into the borehole and structurally connected to the assembly 30 by a suitable adapter. Control signals could be transmitted from the surface to the test tool using acoustic, radio frequency, or similar non-wireline technology. The use of coiled tubing or a tubing string to suspend the assembly 30 within the borehole enables fluid pressure to be passed to the assembly 30 without providing a downhole motor 42 and pump 40. Since wireline operations can be quickly performed and are conventionally used in many oil recovery operations, however, a wireline or other electrically conductive line is a preferred means for both suspending the assembly 30 within the borehole and for transmitting signals in both directions between the downhole tool and the surface equipment. Accordingly, it is preferred that the downhole motor and pump be provided for generating fluid pressure downhole, rather than generating fluid at the surface and then transmitting that fluid pressure downhole to the assembly 30.

Figure 2:
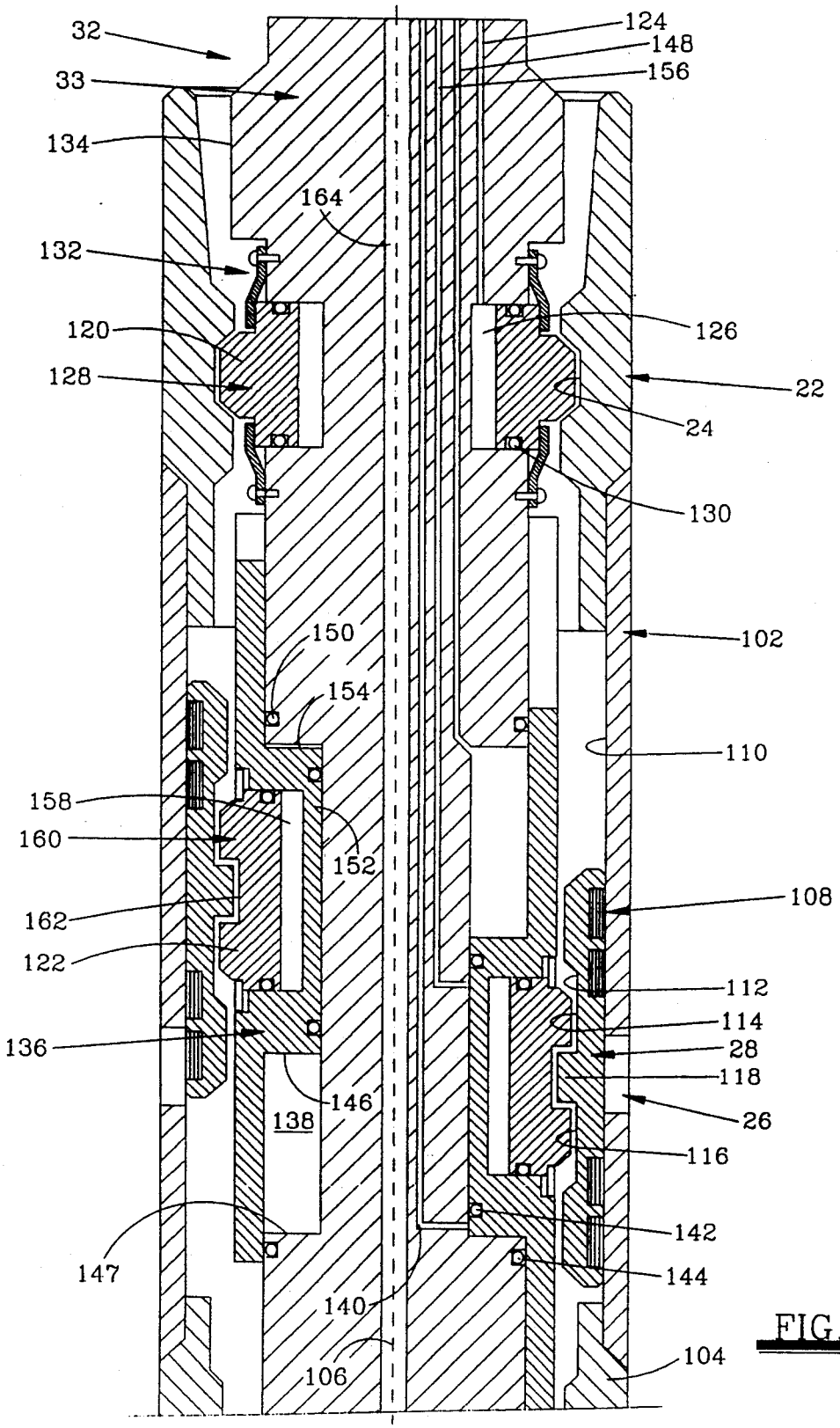
FIG. 2 is a detailed cross-sectional view of one embodiment of a portion of the wireline test tool generally shown in FIG. 1, including an actuating tool with the left side of this tool being depicted in the open position, and the right side of this tool being depicted in the closed position.

FIG. 2 depicts in greater detail the top sub 22, the sliding sleeve 28, and the actuator tool 32 generally shown in FIG. 1. Top sub 22 may be connected by conventional threads to a section of the casing 18, so that the radially innermost surface of the top sub does not extend inward, or extends only slightly inward, of the inner cylindrical surface of the casing. The top sub 22 includes an annular groove 24 which, as shown in FIG. 2, may have a generally U-shaped cross-sectional configuration. As discussed subsequently, the profile of groove 24 is selected for receiving one of the dogs of the actuating tool, and for rejecting the other dog. A sleeve-like body 102 may be weldably secured below sub 22, and includes one or more of the flow ports 26 at the same elevation and generally shown in FIG. 1. A bottom sub 104 may be connected to the lower end of body 102, and in turn may be threadably interconnected with a lower string of casing.

FIG. 2 depicts in greater detail the sliding sleeve 28 generally shown in FIG. 1, and illustrates on the right side of the centerline 106 the sliding sleeve in its normal closed position covering the port 26, and on the left side its uncovered position wherein the interior of the casing 18 is in communication with the formation of interest. The ring-like sliding sleeve 28 includes a plurality of upper seals 108 and a plurality of lower seals for sealing engagement with the inner cylindrical surface 110 of body 102. The inner surface of the sliding sleeve 28 is provided with a specially designed groove 112 which, as shown in FIG. 2, in cross-section has a generally W-shaped configuration. More particularly, the groove 112 in the sliding sleeve 28 may be considered to consist of an upper annular groove 114 and a lower annular groove 116 separated by lip 118 extending radially inward from the base surface of each of the upper and lower grooves. It is a feature of the invention that each of the grooves 24 in the top sub 22 and 112 in the sliding sleeve has a configuration adapted for receiving one of the dogs of the actuating tool and for rejecting the other of the dogs of the actuating tool.

The actuating tool 32 has a generally cylindrical body 33, which in turn carries a pair of radially opposing upper dogs 120 and a pair of radially opposing lower dogs 122. Flow path 124 in the body is in communication with a corresponding one of the solenoid valves 64, and transmits fluid pressure to chamber 126 in response to a control signal. A piston 128 including a conventional seal 130 is provided for moving within the chamber 126 to press each of the upper dogs 120 radially outward into locking engagement with groove 24. The radially outer profile of each of the dogs 120 is substantially similar to the profile of the groove 24, so that the upper dogs can be easily locked into engagement with the sub 22. A conventional biasing member, such as a spring 132, may be provided for biasing each of the dogs 120 to its radially inward position. The outermost surface of the dogs 120 normally does not extend beyond, or extends only slightly beyond, the generally cylindrical outer surface 134 of the actuating tool body 33.

Piston 136 is provided for axial movement within chamber 138 of the actuating tool body 33. By supplying fluid pressure through line 140 and between seal 142 on the piston for sealing engagement with the body and seal 144 on the body 33 for sealing engagement with the piston, fluid pressure is applied to lower face 146 of the piston to move the piston from its lowermost position shown on the right side of FIG. 2 to its uppermost position as shown on the left side of FIG. 2. Similarly, by supplying fluid pressure through line 148 and between seal 152 on the piston for sealing engagement with the body and seal 150 on the body 33 for sealing engagement with the piston, fluid pressure is applied on the top face 154 of the piston to drive the piston 136 from its uppermost position to its lowermost position. Fluid line 156 is provided for supplying fluid pressure to chamber 158 in the piston 136, and piston 160 moves radially outward to extend the lower dogs 122 in a manner functionally similar to operation of the upper dogs 120. A spring or similar biasing member (not shown) biases each of the dogs 122 to a radially inward position. It may be seen that the outer profile of the lower dogs is adapted for mating engagement with the groove 112 in the sliding sleeve, and a gap 162 in the lower dogs 122 is specifically designed to receive the lip 118 of the sliding sleeve. A central flow line 164 may be provided in the actuating tool 32 for passing fluid through the actuating tool and/or passing the wireline through the actuating tool.

The method of the invention will now be described with reference to the embodiments shown in FIGS. 1 and 2. Test wells may be drilled by conventional drilling techniques, utilizing known procedures to reduce contamination of the formation. In view of the long life, high reliability, and minimal contamination requirements of subterranean nuclear migration testing, casing 18 inserted into the well will typically be fabricated from stainless steel or a similar non-corrosive metal. Top subs 22, ports 26, and sliding sleeves 28 can be installed in the casing so that each of these components will be positioned within each of the zones or formations to be tested. A typical test well will pass through multiple test zones, and an exemplary well according to the present invention may thus have five top subs and five sliding sleeves each at a known depth, so that axial movement of the respective sliding sleeve will open the interior of the casing to the formations to be tested. The wireline test tool can be assembled as shown in FIG. 1, and will typically be tested at the surface before each use to ensure operation of all functional components. In an exemplary embodiment, a lower packer 48 and an upper packer 50 may be provided above and below the test tool for sealing engagement with the casing 18. Packers 48 and 50 may be of any type, including wireline positioned packers set by a downhole charge, or hydraulically set packers. The entire test tool assembly 30 and the upper and lower packers may then be lowered into the test well by the wireline 46. Those skilled in the art appreciate that, while it is easy to determine the approximate position of the test tool in a well by monitoring the length of wireline paid out, the exact position of a test tool in a well is difficult to determine, due in part to varying stretch on the wireline itself. According to the present invention, the tool may be lowered to a depth so that the actuator is slightly below the top sub and sleeve associated with the formation to be tested. At this stage, the relative position of assembly 30 within a well bore 20 for testing formation 16 may thus be as shown in FIG. 1. Once so positioned, current may pass through the wireline 46 to power motor 42, so that pump 40 generates a positive pressure in chamber 70. A control signal or pulse may then be forwarded down the wireline 46 for opening a suitable solenoid valve 64, thereby transmitting positive pressure through line 124 into chamber 126, causing the first pair of dogs 120 to move radially outward. Since these dogs are not axially positioned at this time for engagement with the slot 24 in the top sub 22, dogs 120 may move slightly outward but will not be in locked engagement with the casing.

While the dogs 120 remain biased radially outward by fluid pressure, the test tool assembly 30 may be raised in the borehole by pulling up on the wireline 46. This action will cause the first set of dogs 120 to come to a position where they are axially aligned for engagement with the groove 24 in top sub 22, at which time the continued application of hydraulic pressure will cause these dogs to move radially outward and lock the dogs 120 and thus the actuating tool to the casing. To verify that the actuating tool and thus the entire assembly 30 is locked to the casing, a slight additional upward pull can be exerted on the wireline 40, but this tension will not raise the assembly 30. Similarly, the release of tension in the wireline 46 will cause an immediate slack in the wireline, since the assembly 30 is locked to the casing and will not lower within the borehole when the wireline 46 is lowered. Once the assembly 30 is locked in its proper position to the casing, the lower packer 48 may be set in a conventional manner to seal with the casing 18. As previously noted, fluid pressure may be applied to a hydraulically set lower packer 48 to inflate the lower packer, and the upper packer 50 may then similarly be hydraulically set. Alternatively, each of the upper and lower packers may be positioned by the wireline 46, and the packer set by transmitting an actuating signal through the wireline to set off a charge which generates pressure within a setting tool adjacent the packer to set the packers.

With the tool assembly 30 fixed to the casing and the upper and lower packers set, another control signal may be passed through the wireline to operate a solenoid valve and transmit fluid pressure generated by the downhole pump through line 156 to extend the lower set of dogs 122 radially outward. Since the actuator body 33 remains fixed with respect to the top sub 22 by the upper dogs 120, the lower dogs 122 will automatically be in proper position for engaging the sliding sleeve 28 when the lower face 146 of the piston is in engagement with or closely adjacent the stop surface 147 on the body 33. Also, it should be noted that the profile of the groove 112 in the sliding sleeve is such that the first set of dogs 120 cannot come into engagement with the groove in the sliding sleeve. Even if the tool assembly 30 were lowered below the sliding sleeve 26, then the upper dogs 120 biased outward by hydraulic pressure, the dogs 120 would slide past the groove in the sliding sleeve as the wireline was raised. Reliability is thus enhanced by providing a groove 24 in the upper sub which can accept the top dogs 120 but will reject the lower dogs 122, and by providing a groove 112 in the sliding sleeve which can accept the lower dogs 122 but will reject the top dogs 120.

Prior to applying pressure to the piston 136 and thereby axially moving the sliding sleeve 128, the integrity of the seal between the sliding sleeve and body 102 of the casing string may be checked to further increase reliability. A control signal may be transmitted through the wireline 46 for opening a suitable one of the solenoid valves 64, so that a vacuum generated by the pump can be transmitted through a solenoid valve to create a partial vacuum in the annulus between the tool assembly 30 and the casing 18 between the set packers 48 and 50 which is less than the pressure in the formation. (The term "positive pressure" as used herein refers to a pressure greater than that in the formation surrounding the test tool, while the term "partial vacuum" or "negative pressure" refers to pressure which is less than the pressure in the formation surrounding the test tool). Once this negative pressure is created, power to the pump may be discontinued and a suitable pressure sensor 39 located at any desired location within the tool assembly used to monitor and transmit pressure signals to the surface. If the sliding sleeve 28 is maintaining sealing integrity with the casing, this negative pressure level will be maintained at the reduced level for a reasonable period of time. If the seals 108 between the sliding sleeve and the casing are not maintained, this reduced pressure will cause fluid in the formation 16 to pass by the seals 108, thereby raising the reduced pressure in the annulus between the test tool and the casing. In most cases, it is expected that this test will verify that the seals on the sliding sleeve are maintaining sealing integrity with the casing, thereby further ensuring that a proper test is being obtained. If this check shows that the sliding sleeve is not maintaining sealing integrity with the casing, there is an increased likelihood that the interior of the casing below this sliding sleeve has become contaminated, and appropriate corrective action may be initiated.

Assuming that the test described above shows sealing integrity between the sliding sleeve and the casing, a control signal may be passed through the wireline 46 for operating a suitable solenoid valve 64 to cause fluid pressure generated by the pump 40 to be transmitted through line 140, thereby raising the piston 136 from its lowermost position to its uppermost position, and simultaneously raising the sliding sleeve from its covered position to its uncovered position. Once the lower seals 108 pass by the port 26, fluid in the formation 16 is free to enter the interior of the casing, and particularly the annulus between the assembly 30 and the casing. Once a desired quantity of fluid has passed through the port 26, (fluid sensor 41 may be provided to determine that the fluid level has risen to a desired height with respect to the assembly 30), a signal may be transmitted through line 46 to cause fluid pressure from the pump to pass through line 148, thereby moving the piston 136 downward and returning the sliding sleeve to its closed position. The test fluid which entered the interior of the casing may first pass through a suitable line 56 to analyzer chamber 60, where analyzer 62 performs an initial downhole test on the fluid. The results of this test may be forwarded to recorder 72 for making a downhole record of this test, and the data then passed to transmitter 74 for forwarding the test data via line 46 to the surface. If the information from the analyzer 60 transmitted to the surface results in a determination that the selected fluid is likely representative of the fluid in the formation 16, a control signal may be sent down the wireline and the fluid transmitted from analyzer chamber 60 to one of the storage chambers 54. If it is determined that from this analysis that the fluid in chamber 60 is, for some reason, not likely to be indicative of the fluid in the formation 16, the fluid may nevertheless be transmitted to a suitable storage chamber 54, but the sliding sleeve reopened and reclosed according to the above technique so that another fluid sample is obtained. Alternatively, the lower packer 48 could be unset to dump this small quantity of test fluid to the bottom of the test well, and the packer 48 then reset and a new sample recovered by opening the sliding sleeve.

Once a suitable or representative sample of fluid has been collected in a chamber 54, fluid pressure applied to the chamber 158 may be released, so that springs return the lower dogs 122 to their normal radially inward position. Before unsetting the upper and lower packers or releasing the connection between assembly 30 and the casing, the sealing integrity of the returned sliding sleeve and the casing may be verified by applying a positive pressure to the annulus between the casing and the tool, and ensuring that this positive pressure is maintained for a desired period of time. If the sliding sleeve seals are not maintaining integrity, this generated pressure level higher than the pressure in formation 16 will slowly escape to the formation, resulting in a drop in the sensed pressure. If integrity is not maintained, the piston 136 may be activated through another uncovering and covering cycle, and sealing integrity again checked.

Once a suitable sample of fluid has been collected in a chamber 54 and sealing integrity of the sliding sleeve verified, the upper and lower packers 48 and 50 may be unset, and fluid pressure released to the dogs 122 to allow the biasing springs 130 to return these dogs to their radially inward position. At this stage, the entire assembly 30 may be raised or lowered to another depth to perform another sampling operation at another zone to be tested. In this manner, a sample may be reliably obtained from each of multiple zones in a test well, and the tool assembly 30 finally retrieved to the surface with multiple samples obtained with a single trip of the wireline tool.

It is a feature of the present invention that fluid pressure is used to both open and close the sliding sleeve. It is also a feature of the invention that the loss or absence of fluid pressure will automatically allow the tool to become released or unlocked from the casing and the sliding sleeve, thereby substantially reducing the likelihood that the assembly 30 cannot be easily retrieved to the surface. In the event that, for some reason, the assembly 30 is not able to successfully operate the sliding sleeve to obtain a sample, another tool can be lowered to the well bore to mechanically engage and open the sliding sleeve, so that a fluid sample can still be obtained using prior art techniques. The concept of allowing a mechanical backup for the system of the present invention thus substantially increases the overall reliability of the system.

It should be understood that any number of tests may be performed by the downhole analyzer 62. Exemplary tests to make an initial determination that a representative sample from the formation has been collected might include a conductivity test and a pH test. According to the present invention, multiple fluid samples may be obtained from a formation, with each fluid sample stored in a respective and identifiable chamber 54 within the tool, and the tool not moved to another depth to obtain a different sample until the operator is satisfied that a representative sample has been obtained in at least one or more of the chambers. Contamination of the various formations or zones is substantially minimized or completely avoided, since preferably no fluid withdrawn from the formation into the casing is returned to the formation or another downhole formation, and all or almost all sampled fluid is recovered to the surface. Once a proper fluid sample has been obtained from zone, the unsetting of the packers allows the fluid in the casing which was trapped between the packers to be released or dumped to the bottom of the well. This quantity of fluid is, however, comparatively small and would not likely contaminate any of the formations of interest or invalidate the test results. If desired, this small quantity of fluid could be periodically pumped from the well during times when test results are not being taken. Once the test fluid in chambers 54 has been retrieved to the surface, it may be tagged for identification with the formation from which it was removed, and tested utilizing conventional techniques.

It should be understood that various other modifications are contemplated by and within the scope of the present invention. While packers may conventionally be used to seal the interior of the casing above and below a particular sliding sleeve, any number of other sealing mechanisms may be used. For example, upper and lower sealing mechanisms which are part of the test tool assembly may be employed, with these seals activated in response to control signals passed through the wireline. In some cases, an upper packer may not be essential, particularly if formation pressure is relatively low and the system is used to test the uppermost zone of interest. Fluid pressure used to perform each of the various operations described here above typically may be transmitted through a liquid media, such as oil, and accordingly a suitable oil reservoir (not shown) may be provided within the test tool assembly. One or more of the operations of the tool may be pneumatically controlled, and accordingly one or more downhole air pumps may be provided. The steps preferred according to the method of the invention need not be accomplished in the particular sequence described above, and variations of the described sequence may be made while still accomplishing the purposes of the invention.

As previously noted, the invention is not limited to testing nuclear migration in underground formations, and may be used to test for various properties of various well fluids. In particular, it should be understood that the fluid sampled by the technique of the present invention need not be liquid, and gas samples from the formation may be obtained and sampled. The foregoing disclosure and description of the invention are thus illustrative and explanatory, and various other changes in the methods as well as in the details of the illustrated apparatus may be made within the scope of the pending claims and without departing from the present invention.

What is claimed:

1. A method of passing fluid into or from a subterranean formation of interest wherein a casing is provided within a wellbore within the formation, an outer surface of the casing being exposed to fluids within the formation, and the casing preventing the wellbore from caving in, the method comprising:

providing a flow port through the casing;

providing an axially slidable sleeve for normally covering the port to seal the interior of the casing from the formation and for uncovering the port for establishing fluid communication between the formation and the interior of the casing;

lowering a test tool assembly within the casing to a location adjacent the sliding sleeve, the test tool assembly including an actuating tool with an axially movable member for engaging the sliding sleeve;

securing the test tool assembly to the casing;

interconnecting the movable member of the actuating tool and the sliding sleeve;

sealing the interior of the casing below the sliding sleeve;

axially moving the movable member to move the sliding sleeve to an uncovered position and permit a fluid sample to pass through the uncovered port and into a test chamber, and returning the sliding sleeve to a covered position;

disconnecting the movable member and the sliding sleeve;

disengaging the test tool assembly and the casing; and retrieving the test tool assembly and the fluid sample in the test chamber to the surface.

2. The method as defined in claim 1, further comprising:

extending a coiled tubing from the test tool assembly to the surface; and transmitting fluid pressure through the coiled tubing for selectively moving the movable member.

3. The method as defined in claim 1, wherein the step of lowering the test tool assembly includes suspending the test tool assembly within the casing from a wireline.

4. The method as defined in claim 1, further comprising: providing the test chamber within the test tool for receiving fluid; and collecting fluid in the test chamber prior to retrieving the test tool assembly to the surface.

5. The method as defined in claim 1, further comprising:

extending a wireline from the surface to the test tool assembly;

providing a downhole electric motor powered through the wireline;

providing a downhole pump powered by the electric motor for generating hydraulic pressure;

activating one or more of a plurality of control valves for applying the generated hydraulic pressure to move the sliding sleeve to the uncovered position; and actuating one or more of the plurality of control valves for applying the generated hydraulic pressure to return the sliding sleeve to the covered position.

6. The method as defined in claim 1, further comprising:

providing a radially movable first dog for securing the test tool assembly to the casing, and a radially movable second dog for interconnecting the movable member to the sliding sleeve;

providing a first slot in the casing;

providing a second slot in the sliding sleeve;

the step of securing the test tool assembly includes applying hydraulic pressure to radially move the first dog into locking engagement with the first slot in the casings; and the step of interconnecting the axially movable member and the sliding sleeve includes applying hydraulic pressure to radially move the second dog into secured engagement with the second slot in the sliding sleeve.

7. The method as defined in claim 6, further comprising:

forming the second slot in the sliding sleeve for receiving the second dog and for rejecting the first dog.

8. The method as defined in claim 1, further comprising:

providing a seal for sealing engagement between the sliding sleeve and the casing when the sliding sleeve is in its covered position; and testing the integrity of the seal between the sliding sleeve and the casing prior to moving the sliding sleeve to its uncovered position.

9. The method as defined in claim 8, further comprising:

testing the integrity of the seal between the sliding sleeve and the casing subsequent to returning the sliding sleeve to its covered position and prior to disengaging the test tool assembly and the casing.

10. A method of passing fluid into or from subterranean formations of interest wherein a casing is provided within a wellbore with the formations of interest, the method comprising:

a) providing a plurality of flow ports through the casing each at a selected depth;

b) providing a plurality of axially slidable sleeves each for selectively covering a corresponding port to seal the interior of the casing from a formation and uncovering the port for establishing fluid communication between the formation and the interior of the casing;

c) providing a test tool assembly including an actuating tool including an axially movable member for selectively operating each of the plurality of sliding sleeves;

d) lowering the test tool assembly into the casing to a location adjacent a selected sliding sleeve;

e) interconnecting the movable member of the actuating tool and the selected sliding sleeve;

f) sealing the interior of the casing below the sliding sleeve;

g) supplying hydraulic pressure to axially move the sliding sleeve to an uncovered position and permit fluid to pass through the uncovered port;

h) thereafter supplying fluid pressure to return the sliding sleeve to the covered position;

i) disconnecting the movable member and the sliding sleeve;

j) unsealing the interior of the casing;

k) axially moving the test tool assembly to a location adjacent another sliding sleeve and repeating steps e) through j) above; and l) retrieving the test tool assembly to the surface.

11. The method as defined in claim 10, further comprising:

providing a radially movable first dog for securing the test tool assembly to the casing, and a radially movable second dog for interconnecting the movable member to the sliding sleeve;

providing a first slot in the casing;

providing a second slot in the sliding sleeve;

applying hydraulic pressure to radially move the first dog into locking engagement with the first slot in the casing; and the step of interconnecting the movable member and the sliding sleeve includes applying hydraulic pressure to radially move the second dog into secured engagement with the second slot in the sliding sleeve.

12. The method as defined in claim 11, further comprising:

forming the second slot in the sliding sleeve for receiving the second dog and for rejecting the first dog.

13. The method as defined in claim 10, further comprising:

the step of lowering the test tool assembly including extending coiled tubing from the test tool assembly to the surface; and the step of supplying hydraulic pressure including transmitting fluid pressure through the coiled tubing for selectively moving the movable member.

14. The method as defined in claim 10, further comprising:

providing a seal for sealing engagement between the sliding sleeve and the casing when the sliding sleeve is in its covered position; and testing the integrity of the seal between the sliding sleeve and the casing prior to moving the sliding sleeve to its uncovered position.

15. A downhole actuating tool for passing fluid into or form a subterranean formation of interest wherein a casing is permanently positioned within a well bore within the formation and prevents the wellbore from caving in, a flow port is provided through the casing, and a sliding sleeve covers the flow port to seal the interior of the casing from the formation, the actuating tool comprising:

a tool body, a first dog movable radially outward with respect to the tool body for securing the actuating tool to the casing, a member axially movable with respect to the tool body, a second dog for interconnecting the axially movable member and the sliding sleeve to axially move the sliding sleeve in response to fluid pressure applied to the axially movable member, a first flow path within the actuating tool for applying fluid pressure to axially move the movable member and the sliding sleeve in a first direction to uncover the port, and a second flow path within the actuating tool for applying fluid pressure to axially move the movable member and the sliding sleeve in opposing second direction to cover the port.

16. The activating tool as defined in claim 15, further comprising:

biasing means for biasing each of the first dog and second dog radially inward.

17. The activating tool as defined in claim 15, wherein:

the casing is provided with a first locking slot having a predetermined profile;

the sliding sleeve is provided with a second locking slot having a predetermined profile;

the first dog has a radially outward profile for locking engagement with the first slot and for preventing locking engagement with the second slot; and the second dog has a radially outward profile for locking engagement with the second slot.

18. The activating tool as defined in claim 15, further comprising: a sealing member for maintaining sealing engagement between the sliding sleeve and the casing when the sliding sleeve is in its covered position; and a flow path within the actuating tool for subjecting the interior of the casing adjacent the sliding sleeve to a differential pressure generated by a pump for testing the integrity of the sealing member.

19. A method of passing fluid into or from a subterranean formation of interest wherein a casing is provided within a wellbore within the formation, the method comprising:

providing a flow port through the casing;

providing an axially slidable sleeve for selectively covering the port to seal the interior of the casing from the formation and for uncovering the port for establishing fluid communication between the formation and the interior of the casing;

lowering a test tool assembly within the casing from coiled tubing extending from the surface to a location within the wellbore adjacent the sliding sleeve, the test tool assembly including an actuating tool with an axially movable member for engaging the sliding sleeve;

securing the test tool assembly to the casing;

interconnecting the movable member of the actuating tool and the sliding sleeve;

sealing the interior of the casing below the sliding sleeve;

transmitting fluid pressure through the coiled tubing for selectively moving the movable member and thereby the sliding sleeve to an uncovered position and permit a fluid sample to pass through the uncovered port and into a test chamber;

returning the sliding sleeve to a covered position;

disconnecting the movable member and the sliding sleeve;

disengaging the test tool assembly and the casing; and retrieving the test tool assembly and the fluid sample in the test chamber to the surface.

20. The method as defined in claim 19, further comprising:

providing the test chamber within the test tool for receiving fluid; and collecting fluid in the test chamber prior to retrieving the test tool assembly to the surface.

21. The method as defined in claim 19, further comprising:

providing a radially movable first dog for securing the test tool assembly to the casing, and a radially movable second dog for interconnecting the movable member to the sliding sleeve;

providing a first slot in the casing;

providing a second slot in the sliding sleeve;

the step of securing the test tool assembly including applying hydraulic pressure to radially move the first dog into locking engagement with the first slot in the casings; and the step of interconnecting the axially movable member and the sliding sleeve including applying hydraulic pressure to radially move the second dog into secured engagement with the second slot in the sliding sleeve.

22. The method as defined in claim 19, further comprising:

providing a seal for sealing engagement between the sliding sleeve and the casing when the sliding sleeve is in its covered position; and testing the integrity of the seal between the sliding sleeve and the casing prior to moving the sliding sleeve to its uncovered position.

23. The method as defined in claim 22, further comprising:

testing the integrity of the seal between the sliding sleeve and the casing subsequent to returning the sliding sleeve to its covered position and prior to disengaging the test tool assembly and the casing.

24. A method of passing fluid into or from a subterranean formation of interest wherein a casing is provided within a wellbore within the formation, the method comprising:

providing a flow port through the casing;

providing an axially slidable sleeve for selectively covering the port to seal the interior of the casing from the formation and for uncovering the port for establishing fluid communication between the formation and the interior of the casing;

lowering a test tool assembly within the casing from a wireline extending to the surface to a location within the wellbore adjacent the sliding sleeve, the test tool assembly including an actuating tool with an axially movable member for engaging the sliding sleeve;

providing a downhole motor powered through the wireline;

providing a downhole pump powered by the motor for generating hydraulic pressure;

securing the test tool assembly to the casing;

interconnecting the movable member of the actuating tool and the sliding sleeve;

sealing the interior of the casing below the sliding sleeve;

activating one or more of a plurality of control valves for applying the generated hydraulic pressure to move the sliding sleeve to an uncovered position and thereby permitting a fluid sample to pass through the uncovered port and into a test chamber;

actuating one or more of the plurality of control valves for applying the generated hydraulic pressure to return the sliding sleeve to the covered position;

disconnecting the movable member and the sliding sleeve;

disengaging the test tool assembly and the casing; and retrieving the test tool assembly and the fluid sample in the test chamber to the surface.

25. The method as defined in claim 24, further comprising:

providing the test chamber within the test tool for receiving fluid; and collecting fluid in the test chamber prior to retrieving the test tool assembly to the surface.

26. The method as defined in claim 24, further comprising:

providing a radially movable first dog for securing the test tool assembly to the casing, and a radially movable second dog for interconnecting the movable member to the sliding sleeve;

providing a first slot in the casing;

providing a second slot in the sliding sleeve;

the step of securing the test tool assembly including applying hydraulic pressure to radially move the first dog into locking engagement with the first slot in the casings; and the step of interconnecting the axially movable member and the sliding sleeve including applying hydraulic pressure to radially move the second dog into secured engagement with the second slot in the sliding sleeve.

27. The method as defined in claim 24, further comprising:

providing a seal for sealing engagement between the sliding sleeve and the casing when the sliding sleeve is in its covered position; and testing the integrity of the seal between the sliding sleeve and the casing prior to moving the sliding sleeve to its uncovered position.

28. The method as defined in claim 27, further comprising:

testing the integrity of the seal between the sliding sleeve and the casing subsequent to returning the sliding sleeve to its covered position and prior to disengaging the test tool assembly and the casing.

* * * * *